US007640831B1

(12) United States Patent
Vitale

(10) Patent No.: US 7,640,831 B1
(45) Date of Patent: Jan. 5, 2010

(54) POP TAB REMOVER

(76) Inventor: Laura L. Vitale, 1511 Gedern, Columbia, IL (US) 62236

( * ) Notice: Subject to any disclaimer, the term of this patent is extended or adjusted under 35 U.S.C. 154(b) by 0 days.

(21) Appl. No.: 11/906,020

(22) Filed: Sep. 28, 2007

(51) Int. Cl.
*B67B 7/00* (2006.01)
*B25B 27/00* (2006.01)

(52) U.S. Cl. ..... 81/3.36; 81/3.08

(58) Field of Classification Search ..... 81/3.36, 81/3.08, 3.37, 3.44, 3, 29, 3.55, 3.56, 3.47, 81/3.49, 417, 3.29
See application file for complete search history.

(56) References Cited

U.S. PATENT DOCUMENTS

| | | | | | |
|---|---|---|---|---|---|
| 436,818 | A | | 9/1890 | Wiatt et al. | |
| 1,248,923 | A | | 12/1917 | Ryczek | |
| 1,678,313 | A | * | 7/1928 | Atkinson | 81/415 |
| 2,354,480 | A | * | 7/1944 | Rossmann | 269/48.4 |
| D196,381 | S | | 9/1963 | Basilotta | |
| 4,457,306 | A | * | 7/1984 | Borzone | 81/418 |
| 4,507,839 | A | * | 4/1985 | Simpson | 29/268 |
| 4,633,740 | A | * | 1/1987 | Jacobs | 81/3.09 |
| D323,772 | S | | 2/1992 | Sage | |
| D342,002 | S | | 12/1993 | Sage | |
| 5,826,502 | A | | 10/1998 | Wade | |
| 6,131,495 | A | * | 10/2000 | Chen | 81/417 |
| D497,782 | S | | 11/2004 | Thiede | |

* cited by examiner

*Primary Examiner*—Hadi Shakeri
(74) *Attorney, Agent, or Firm*—Kevin L. Klug; David W. McGuire

(57) ABSTRACT

A pop tab remover apparatus and method of use having a fork and can support combination as a head which allow for easy removal of a tab from a soda, beer, or other type of can. The apparatus and method of use allows a user to easily place the fork between a tab and a can, seat or mate the can support near or at the top of the can, squeeze the handles and remove the tab with a "pop" like report. Unlike the prior art, the present art removes a can tab in a fraction of a second which aids in the efficient recycling of tabs.

4 Claims, 16 Drawing Sheets

POP TAB REMOVER

BACKGROUND OF THE INVENTION

This invention relates to soda, beer, or other types of can recycling devices in general and more specifically to an apparatus and method for removing the tabs from soda, beer, or other types of cans for recycling or charity donation. The present invention uniquely removes the tab of an aluminum or other type of can easily, quickly, and without damage to the can.

Aluminum and other types of cans have long been collected and recycled. It is widely understood that the can tabs may also be removed from the cans and recycled separately. As the tabs occupy considerably less volume per unit mass than the cans, amounts recovered from a recycling facility for equivalent volumes are considerably higher for tabs. This phenomena has prompted numerous charities to initiate fund raising projects which collect the tabs and recycle large volumes of them with the proceeds going to the charity. An example of such a charity is the Ronald McDonald houses.

Prior art pop tab removal techniques required users to grasp the tab between the thumb and forefinger and continuously bend and flex the tab until a break from the aluminum can occurs. This was time consuming (typically taking about 10 seconds), laborious, and often left part of the tab attached to the can. The present art utilizes a unique head apparatus connected via a pivot with a pair of force application handles which provide quick, easy, and amusingly interesting tab removal within a fraction of a second. The present art resembles a pliers type device with a head apparatus comprising a uniquely designed lower fork and upper can support. The lower fork fits under the tab and around the tab holding post (an integral rivet like protrusion from the can top) while the upper can support fits within the topmost rim of the can. When force is applied to the handles, the lower fork and upper can support move closer with the upper can support seating onto the topmost rim of the can. When sufficient force is applied to the handles, the tab is removed from the tab holding post and can. The required force is so minimal that a child can operate the present art.

The present art allows charities and persons which support them to easily and quickly remove large numbers of can tabs without the prior art labor. The present art further provides an amusing pastime activity for adults and children in support of their charity of choice.

Accordingly, it is an object of the present invention to provide a pop tab remover which quickly and easily removes tabs from soda, beer, or other types of cans via a simple squeeze of a user's hand.

Another object of the present invention is to provide a pop tab remover which requires a minimal amount of force to remove the can tabs.

A further object of the present invention is to provide a pop tab remover which is easily and economically manufactured.

SUMMARY OF THE INVENTION

To accomplish the foregoing and other objects of this invention there is provided a pop tab remover having a having a head, a pivot, and two or more force application handles. The head comprises a uniquely shaped lower fork and a uniquely shaped upper can support which mate or interface with a tab and can.

In a preferred embodiment, the lower fork is of a planar substantially circular material having a fork slot which is attached with a lower pivot arm. Also in a preferred embodiment, the upper can support comprises a substantially circular ring attached with an upper pivot arm. Each of the pivot arms are preferably of a planar material and pivotally connected at a pivot point. Said pivot point comprises a short shaft through a hole in each of said pivot arms. Said shaft may comprise a plurality of elements including but not limited to a screw, a rivet, or an extension on one of the pivot arms.

One or more handles extend proximally from the pivot arms and are preferably covered with a soft flexible grip material. In the preferred embodiment, each handle has a tubular support between the handle and the grip material. This tubular support assures that the grip material retains a substantially circular cross section which allows a more user comfortable grasp. The preferred embodiment also utilizes a torsion spring which is mounted on or with said pivot and which has one or more spring arms extending onto and secured with said handles. The torsion spring provides a natural opening bias force to the head which assures that the head is easily mated with a can and tab.

In the preferred embodiment, the upper can support circular ring is of a substantially half spherical form with a slot. The circular ring is substantially represented by the equator of the half sphere which is positioned closest to the lower fork. The slot is positioned substantially orthogonal to the circular ring and extends toward the pole of the substantially half sphere. Said slot provides clearance for the lower pivot arm when the handles are squeezed and the ring approaches the fork. That is, the slot is of a greater width than the thickness of the lower pivot arm.

The aforementioned component parts may be manufactured from a variety of materials which provide the structural strength necessary. These include but are not limited to materials such as iron, steel, aluminum, titanium, magnesium and alloys thereof, plastics or other polymers, composites, and various woods. The grip material is preferably of a soft urethane foam but may be of any material in alternative embodiments, including but not limited to polymers, composites, metals, synthetic and natural rubbers, and woods.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
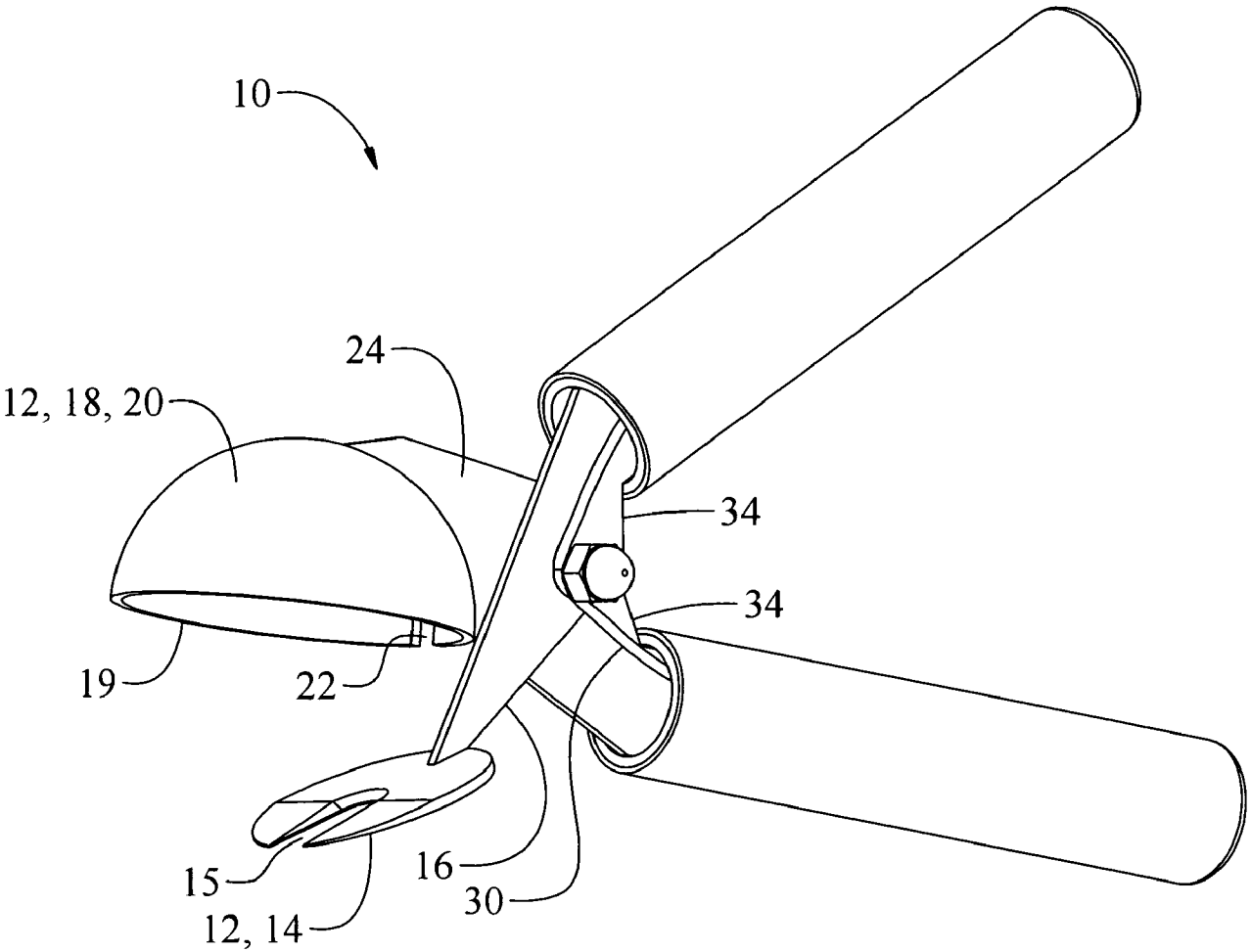
FIG. 1 is a front perspective view of the pop tab remover.
Figure 2:
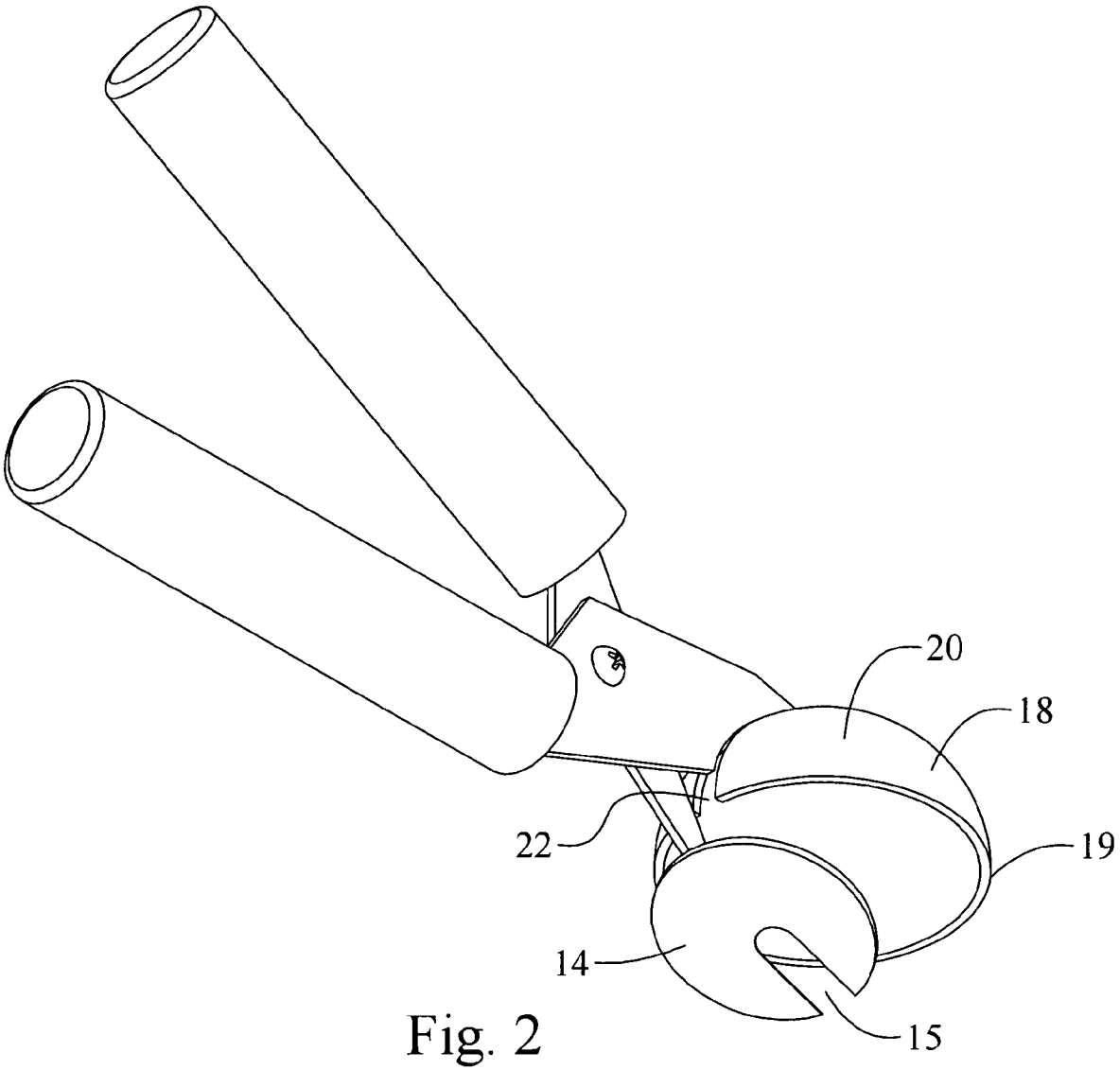
FIG. 2 is a rear perspective view of the pop tab remover.
Figure 3:
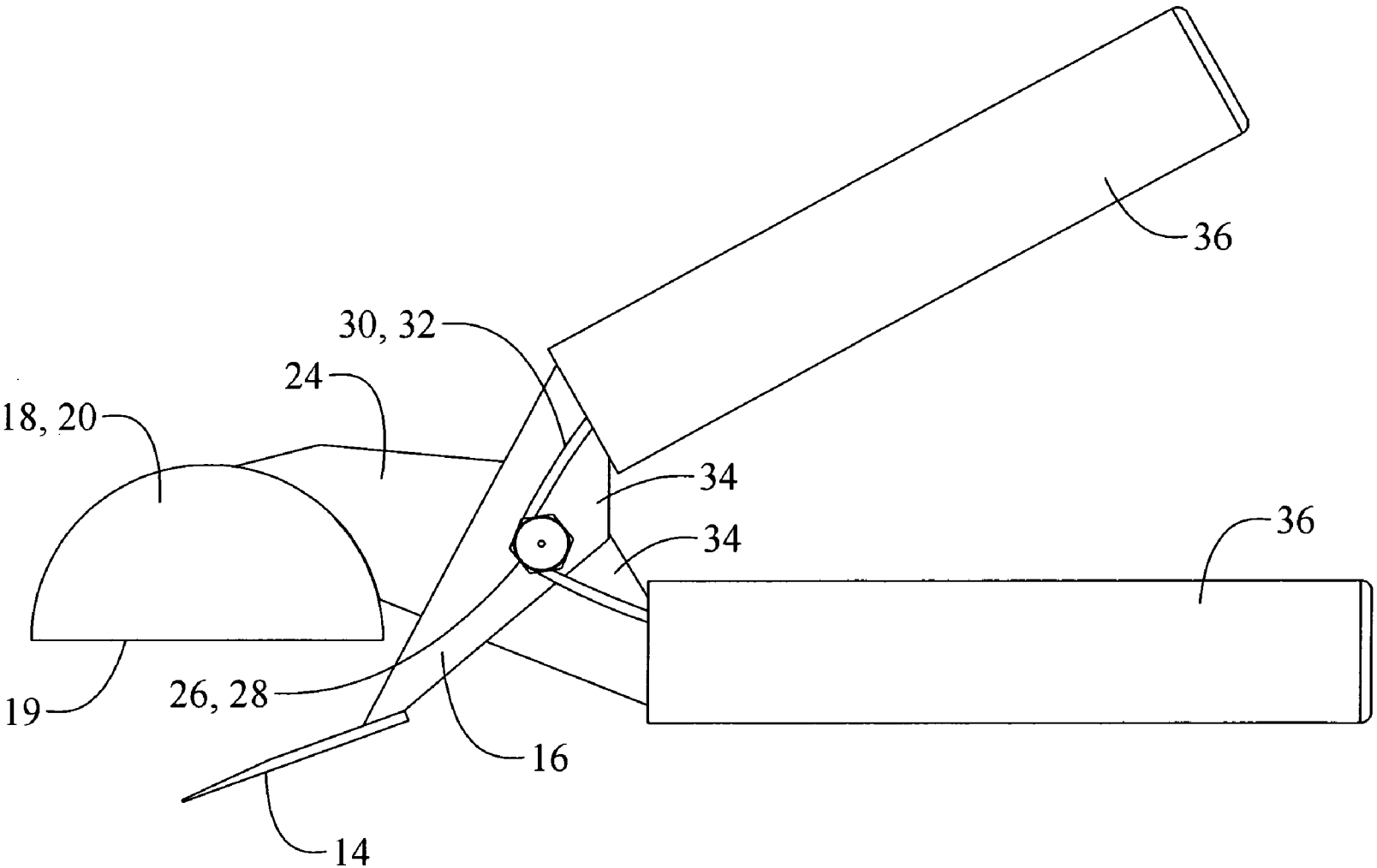
FIG. 3 is a left side plan view thereof.
Figure 4:
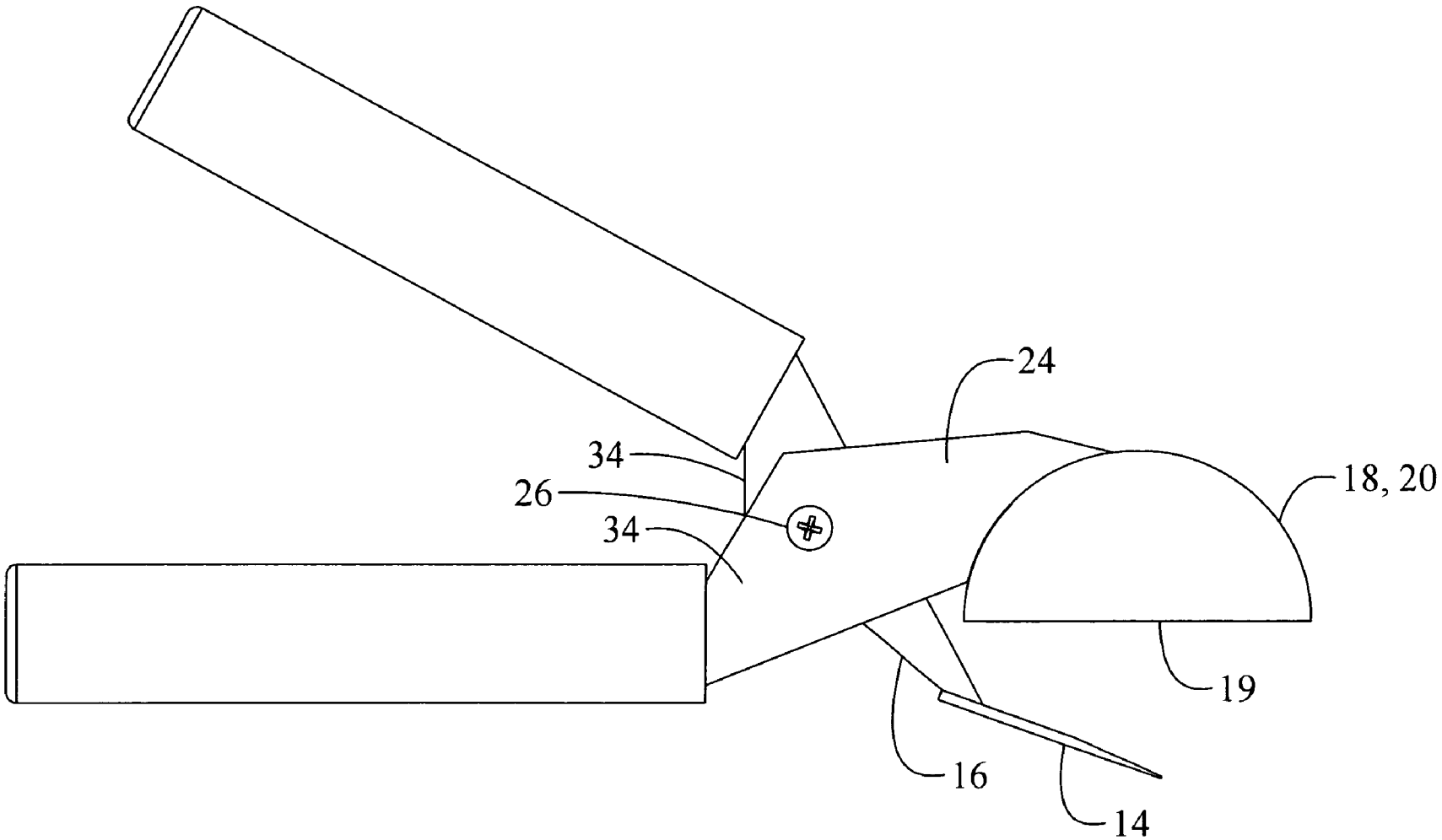
FIG. 4 is a right side plan view thereof.
Figure 5:
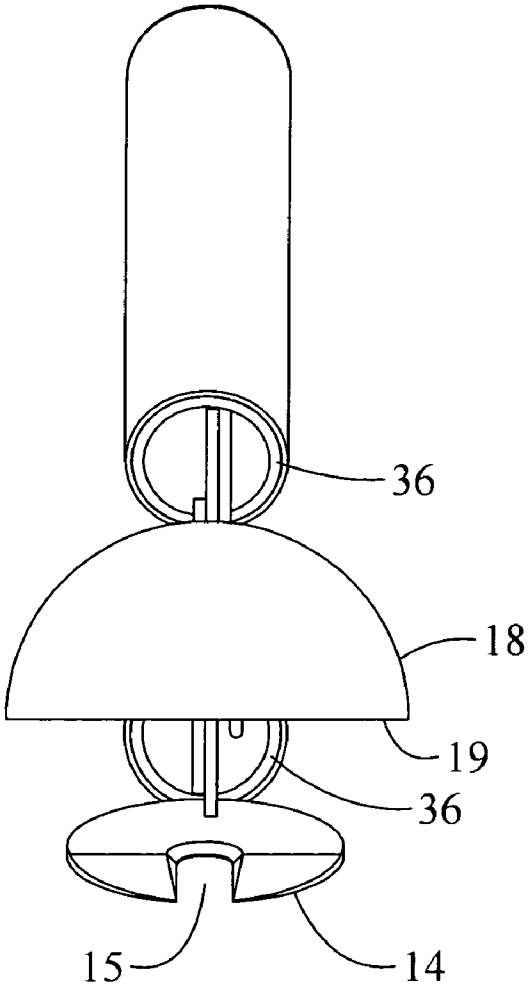
FIG. 5 is a front side plan view thereof.
Figure 6:
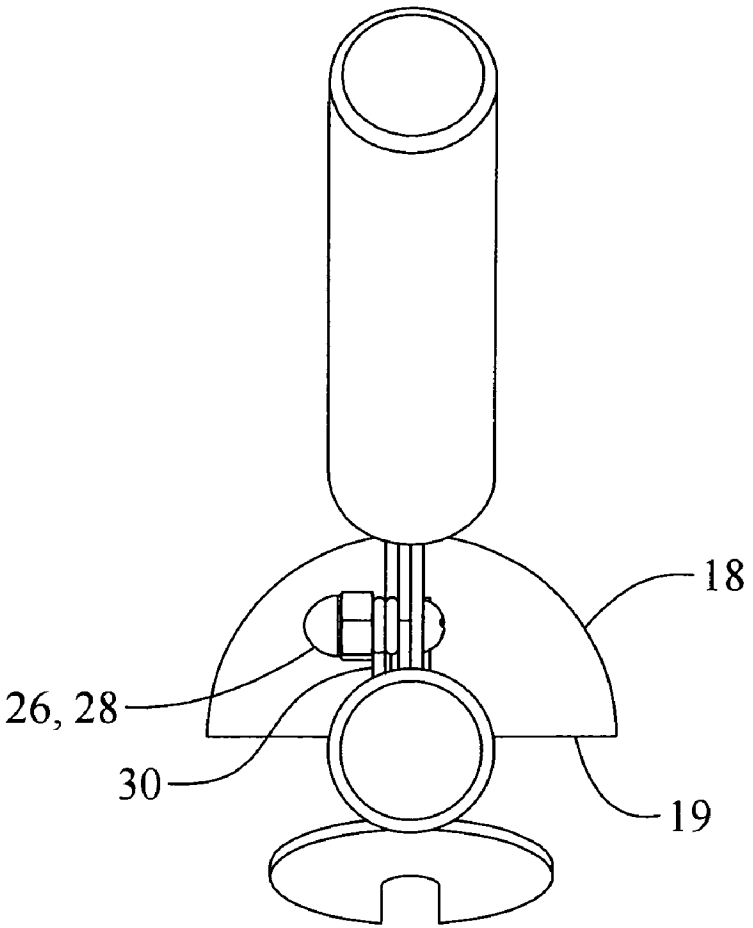
FIG. 6 is a rear side plan view thereof.
Figure 7:
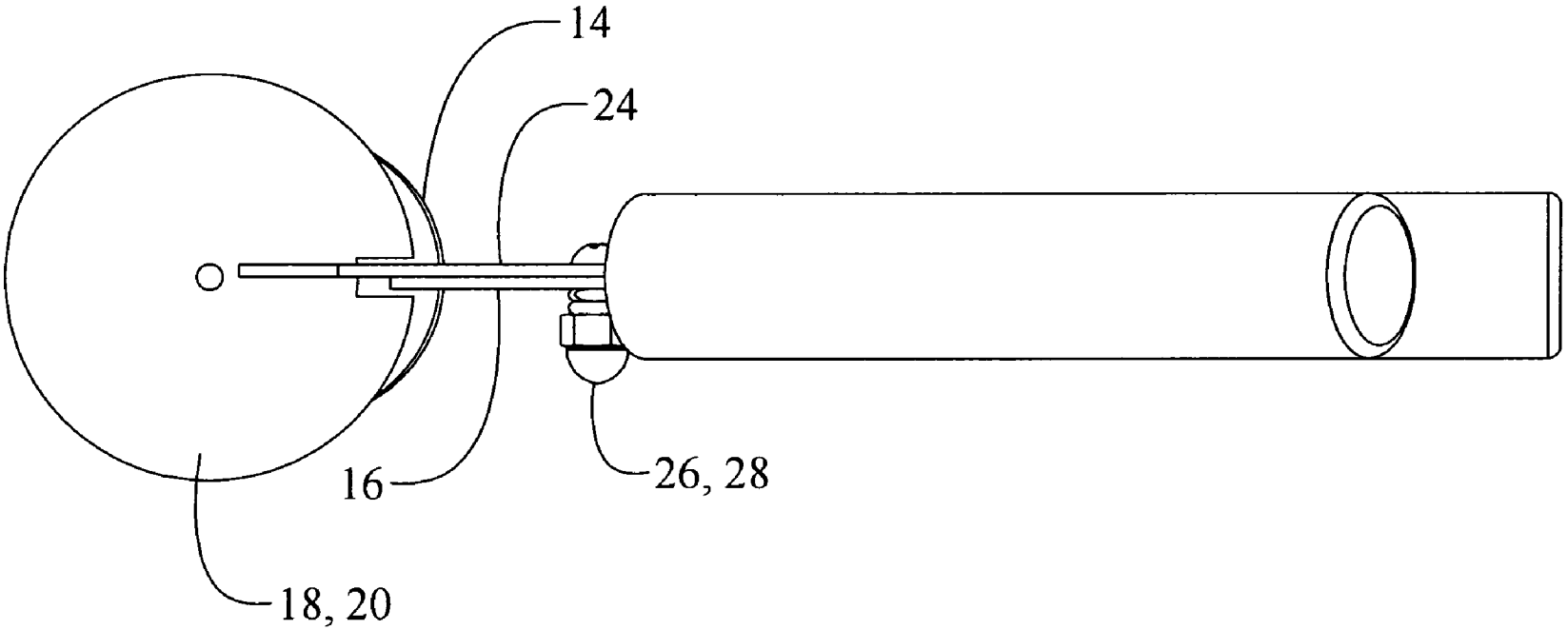
FIG. 7 is a top side plan view thereof.
Figure 8:
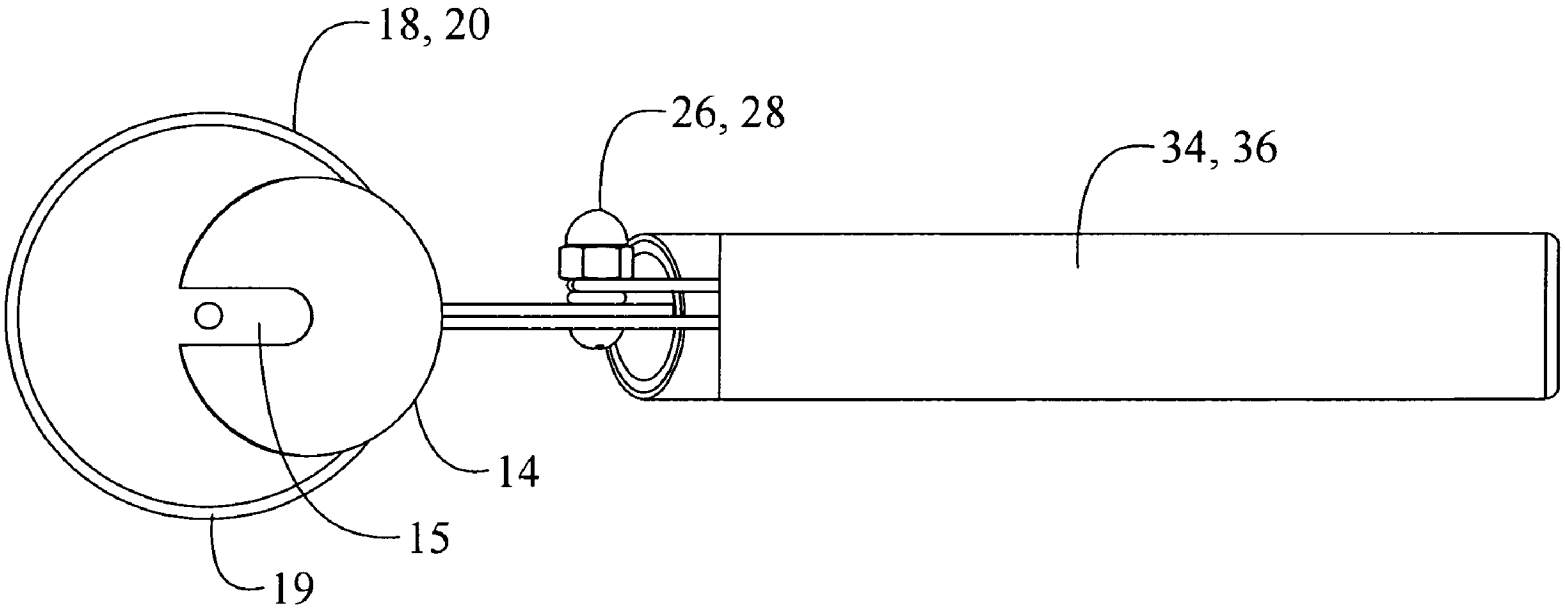
FIG. 8 is a bottom side plan view thereof.
Figure 9:
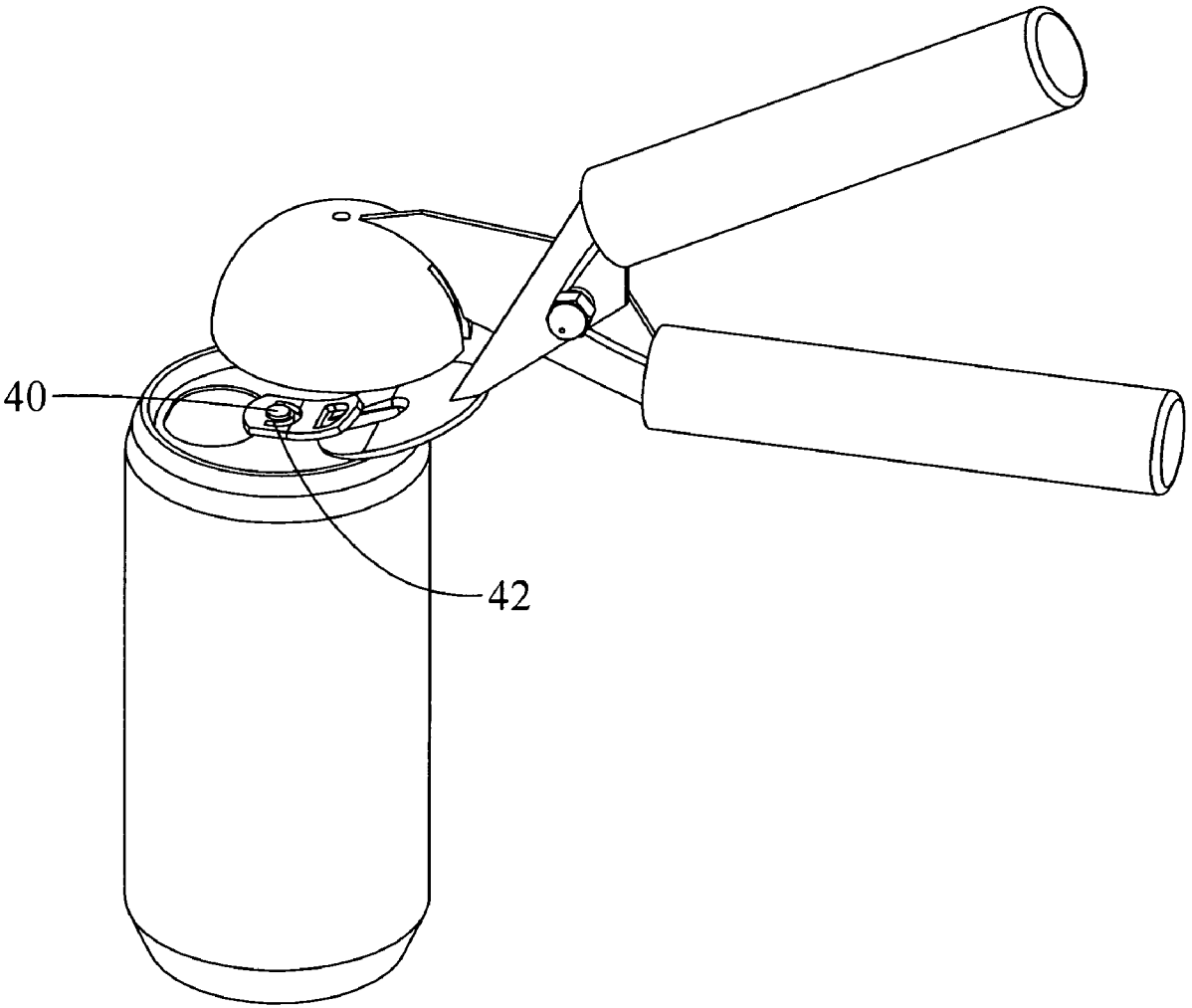
FIG. 9 is a side perspective view of the pop tab remover in an open position as the apparatus is mated onto a can top.
Figure 10:
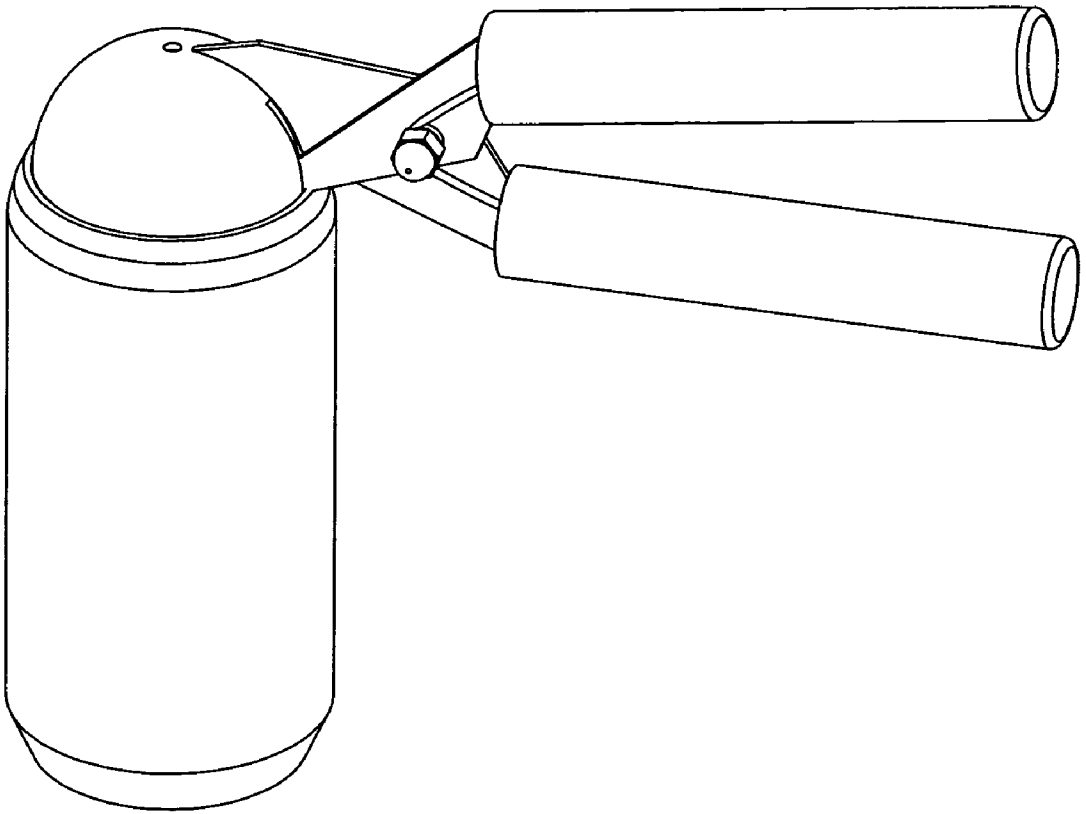
FIG. 10 is a side perspective view of the pop tab remover in a closed position, mated onto a can top, prior to tab removal.
Figure 11:
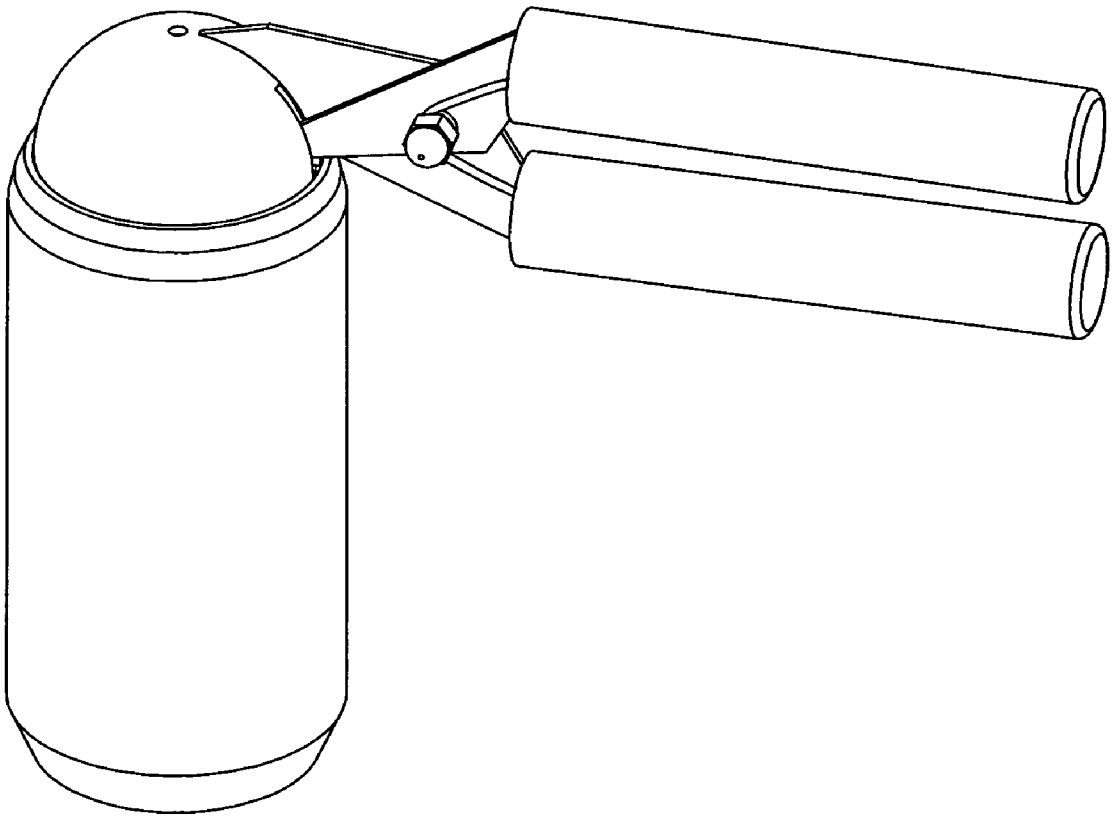
FIG. 11 is a side perspective view of the pop tab remover in a closed position, mated onto a can top, after tab removal.
Figure 12:
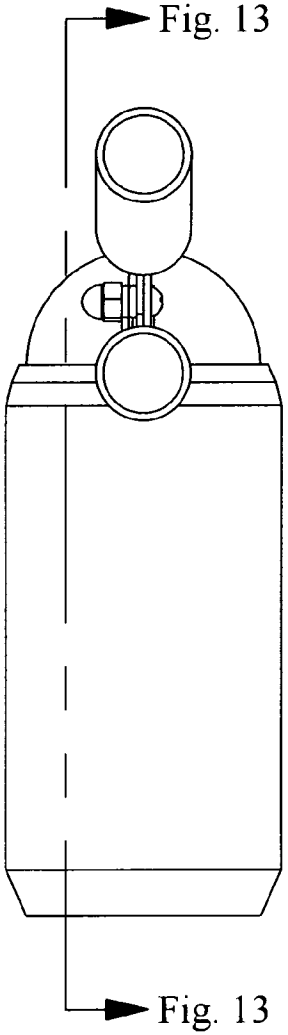
FIG. 12 is a rear plan view of the pop tab remover in a closed position, mated onto a can top, prior to tab removal.
Figure 13:
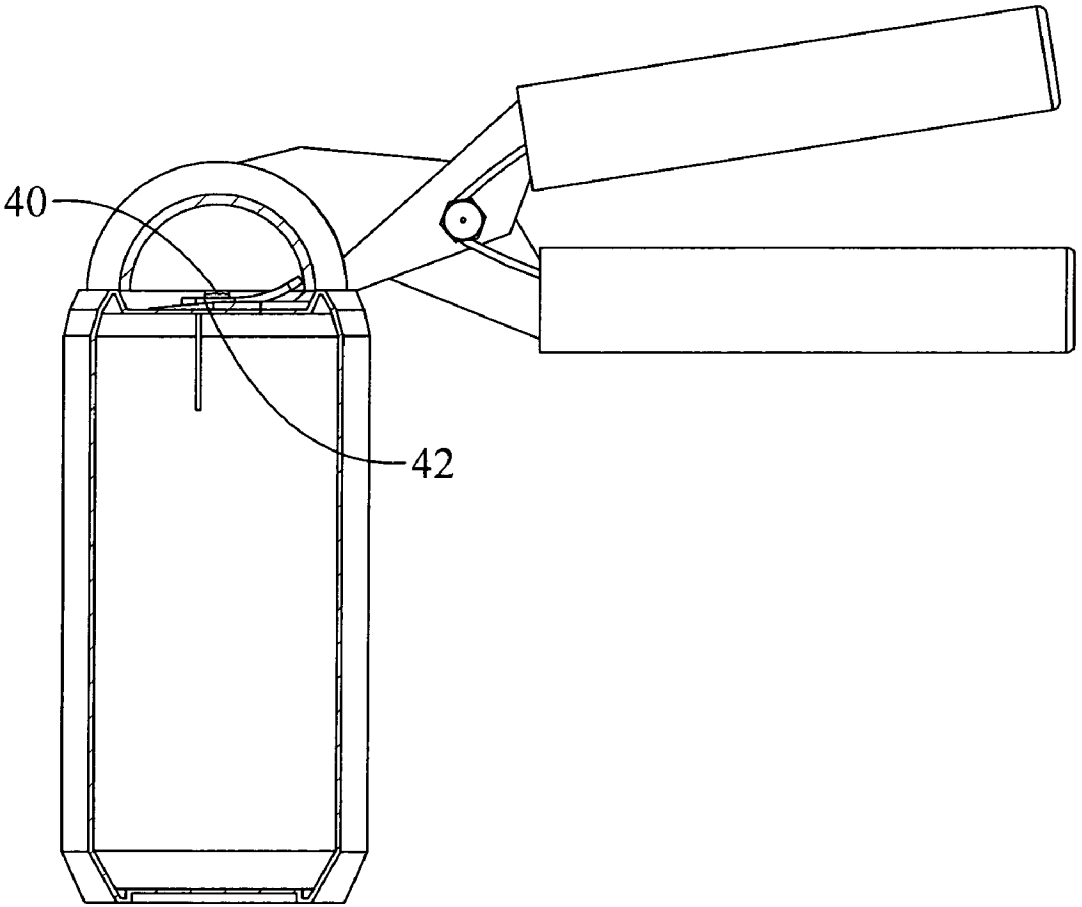
FIG. 13 is a cross sectional view taken along line 13-13 of FIG. 12.
Figure 14:
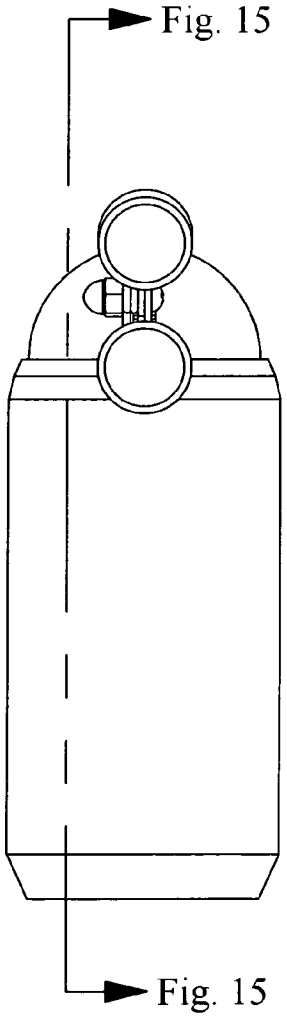
FIG. 14 is a rear plan view of the pop tab remover in a closed position, mated onto a can top, after tab removal.
Figure 15:
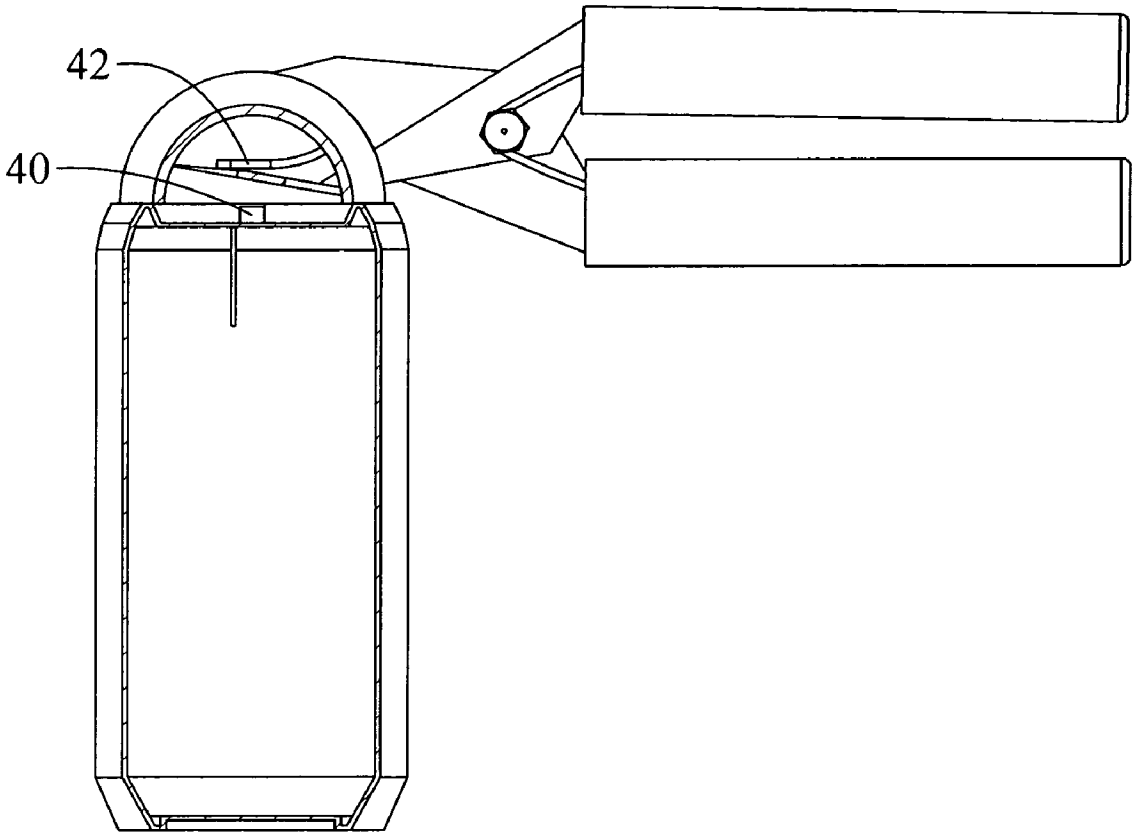
FIG. 15 is a cross sectional view taken along line 15-15 of FIG. 14.
Figure 16:
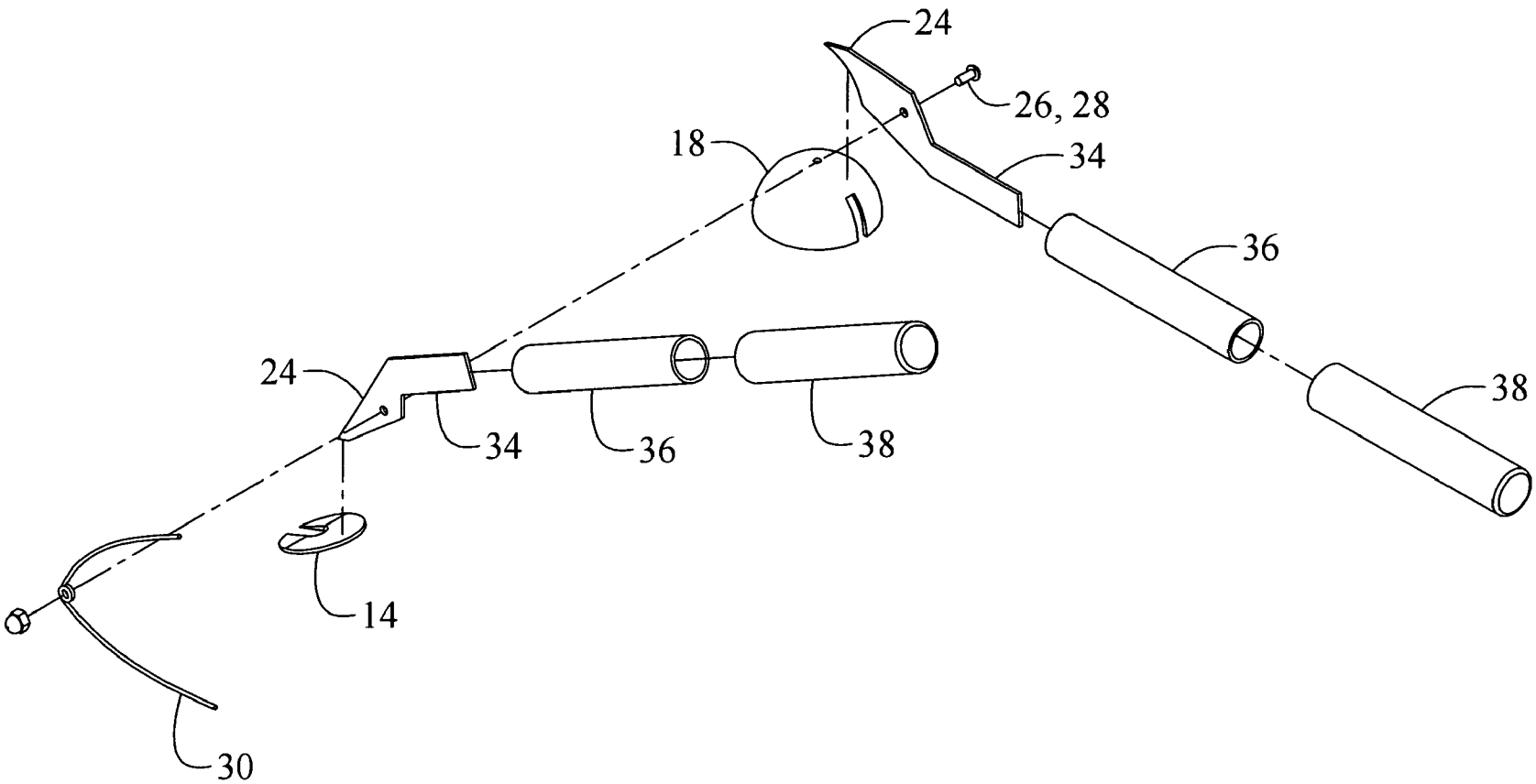
FIG. 16 is an assembly view of the pop tab remover.

Referring now to the drawings, there is shown in FIGS. 1-9 a preferred embodiment of a pop tab remover 10 having a unique head apparatus 12, a pivot 26, and two force application handles 34. The present art apparatus 10 is uniquely capable of removing the tab from a soda, beer, or other type of can in a quick, easy, and convenient manner.

The preferred embodiment of the present art 10 comprises a distal head 12 having a lower fork 14 and an upper can support 18. When a handle 34 force is applied during use, the lower fork 14 and the upper can support 18 approach and impart a removal force upon the can tab. The lower fork 14 is attached via a lower pivot arm 16 to at least one of said force application handles 34. The upper can support 18 is also attached via an upper pivot arm 24 to at least one of said force application handles 34 opposite the handle 34 attached with said lower pivot arm 16. In the preferred embodiment, the arms 16, 24 and handles 34 are each formed as a single piece from a planar sheet metal material. That is, each combination of arm 16, 24 and handle 34 is stamped or cut from a sheet metal or other sheet material into the overall form of arm 16, 24 and handle 34. The fork 14 and can support 18 are preferably attached to the arms 16, 24 via welding but may be attached in a plurality of ways in alternative embodiments, including but not limited to adhesives, integral molding, press fits, or fasteners such as screws or rivets. Further alternative embodiments may form the arms 16, 24 and handles 34 in a plurality of ways or from a plurality of separate parts or pieces.

In a preferred embodiment, the lower fork 14 comprises a substantially planar element having a fork slot 15 of sufficient width to fit or slide around the tab holding post 40 on the can top and attachment arm 42 of a can tab. That is, the slot 15 must not only have sufficient width to slide around the holding post 40 between the can and tab but must also slide around the tab extension or tab attachment arm 42 which is held by said rivet. Proper width sizing of the slot 15 allows complete removal of the tab and its extension or attachment arm 42 from the can during apparatus 10 utilization. For enablement purposes only, the slot 15 is approximately 0.3 inch in width.

A preferred embodiment of the present fork 14 comprises a substantially circular element with a reduced thickness nearest the circumferential portion of slot 15 and fork 14 intersection. The reduced thickness allows easy insertion of the fork 14 between the tab and can. Preferably, the fork 14 element size and shape is sufficiently to substantially cover most of the can opening (i.e. liquid exiting portion) whereby the probability of the tab falling into the can after removal is minimized. Alternative embodiments may utilize a plurality of fork 14 forms, including but not limited to rectangular, semi-circular, octagonal, hexagonal, etc., provided the fork 14 is sized to fit between the can and tab.

The upper can support 18 represents the jaw portion of the apparatus 10 opposite the lower fork 14. The upper can support 18 provides not only a force application function but, in a preferred embodiment, provides an apparatus 10 centering registration with the top of the can whereby an aligned and substantially perpendicular removal force is applied to the tab. In a preferred embodiment, the upper can support 18 is represented as a circular ring 19 with an outside diameter substantially equivalent to or smaller than an inside diameter of a standard can mouth. In order to provide a desired removal force between the can tab and the can, a solid and substantially non-deforming surface or portion of the can must mate or seat with a portion of the upper can support 18. The topmost rim of the can, at the seam between the top cap and the can body, is the strongest and most non-deforming portion of the can. The upper can support 18 ring 19 which fits within, around, at, or onto the topmost seam or rim of the can provides the most stable force application platform for the apparatus 10 which is necessary for tab removal without incurring excessive travel of the force application handles 34. That is, if the can deforms during tab removal, the handles 34 must incur a greater displacement relative to each other which may result in incomplete tab removal or a deformation of the can without tab removal.

Utilization of a circular ring 19 upper can support 18 which substantially matches the inside diameter of a can mouth assures that the apparatus 10 centrally registers on the can top during tab removal. Removal of the can tab is best accomplished when the force applied to the tab is substantially perpendicular to the topmost surface of the can (i.e. top cap of the can). If the upper can support 18 intimately fits inside the can mouth, proper positioning of the lower fork 14 is assured during tab removal.

The preferred embodiment of the present art apparatus 10 utilizes a substantially half spherical form 20, spherical cap, hemispherical, or dome shaped portion attached with the upper pivot arm 16 with the equator of the sphere 20, cap, or dome forming said circular ring 19. The pole of said half spherical form 20 is positioned substantially opposite said circular ring 19 and said lower fork 14 when the apparatus 10 is assembled. It is recognized that a substantial portion of the half sphere may be removed or be void of material without affecting the form or function of the circular ring 19. Nevertheless, by utilizing the substantially half sphere 20, the circular ring 19 is supported around the circumference and allows manufacture of the half sphere 20 or equivalent from a thinner material which may be formed from a die and punch. Alternative embodiments may utilize an upper can support 18 of any form which substantially retains the circular ring 19 form which mates with the can mouth or top. Further alternative embodiments may utilize an upper can support 18 which simply rests upon or substantially near a portion of the topmost seam of the can in the form of a circular ring or simply an extension from the upper pivot arm 24. Yet further alternative embodiments may utilize a circular ring 19 which is only partially circular or arcuate and is sized to mate or rest interior to, exterior to, or on the mouth seam.

For the preferred embodiment, a slot 22 is formed into the half sphere 20 which provides clearance for the lower pivot arm 16. That is, when the apparatus 10 is registered with a can top and each handle 34 displaced toward the other handle 34 the lower pivot arm 16 intersects the outline of the substantially half sphere 20 which would prohibit further displacement and tab removal if the slot 22 were not present. The width of said slot 22 must be greater than the thickness of the lower pivot arm 16.

The lower pivot arm 16 and upper pivot arm 24 are each shaped to attach with the lower fork 14 and upper can support 18 respectively without interference with the other components of the apparatus 10 during use. Although a plurality of forms and shapes are contemplated, as shown, the lower pivot arm 16 is a substantially triangular form with a distal vertex attached with the lower fork and proximal portion attached with a first of said handles 34. Also as shown, the upper pivot arm 24 is of a compound form with a distal portion substantially matching the outline of the upper can support 18 and a proximal portion connecting with the a second of said handles 34 positioned opposite the first of said handles 34. Each of the pivot arms 16, 24 in combination with the corresponding first and second handles 34 respectively are two separate assemblies which are pivotally connected at said pivot 26. Alternative embodiments may utilize a plurality of forms and shapes for the pivot arms 16,24, including but not limited to bar stock, forged or cast arms, or ridged sheet material.

In a preferred embodiment, the lower and upper pivot arms 16, 24 each have a hole through which a pivot 26, preferably comprising a shaft 28, is located. The shaft 28 is preferably in the form of a headed screw with accompanying nut which pivotally sandwiches the arms 16, 24 together. Alternative embodiments may utilize a plurality of pivot forms, including but not limited to rivets, headed shafts, or pins as a substitution for said shaft 28. Further alternative embodiments may integrally form said shaft 28 with one or more of said arms 16, 24.

Although not essential to operation, the preferred embodiment utilizes a torsion spring 30 having one or more spring arms 32 in order to provide a return or opening bias to the head apparatus 12. The preferred embodiment attaches or mates the spring arms 32 with the handles 34 although alternative embodiments may attach to or mate the spring arms 32 with the pivot arms 16, 24. For the preferred embodiment, the each of the spring arms 32 insert into a tubular support 36 formed as a portion of the handle 34. To provide said bias, further alternative embodiments may utilize compression or other types of springs between the handles 34 or arms 16, 24. Alternative embodiments may seat or retain said spring arms 32 via posts, retainers, clips, or other retention methods with said pivot arms 16, 24 or said handles 34.

The tubular support 36, although also not essential to operation, fits over and is attached to a portion of each handle 34 and provides a substantially circular cross sectional form which comfortably fits the palm of the user. The tubular support 36 form also allows a tubular grip material to be fitted over the support 36 whereby a secure and comfortable feel is provided to the user. Alternative embodiments may utilize a partially tubular or partial circular cross section support 36 which is attached with said handles.

In operation, the user first inserts the lower fork 14 between the tab and can top. That is, the fork slot 15 surrounds the tab holding post 40 on the can top and the tab extension or attachment arm 42. The handles 34 are then displaced or squeezed whereby the upper can support 18 mates with the can top inside or at the seam at the can top. A slightly increased force is further applied whereby the tab is removed from the can top with a "pop" like report. The tab is then removed from a top surface of the fork 14.

From the foregoing description, those skilled in the art will appreciate that all objects of the present invention are realized. A pop tab remover apparatus and method of use is shown and described. The apparatus and method of use allows adults and children to quickly and easily remove tabs from aluminum or other types of cans with a minimal amount of application force. The apparatus and method of use further provides an amusing pastime in support of a user's charity of choice.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A pop tab remover comprising:

a head apparatus having a lower fork and an upper can support; and a lower pivot arm attached with said lower fork and an upper pivot arm attached with said upper can support; and a first force application handle attached with said lower pivot arm and a second force application handle attached with said upper pivot arm; and a pivot pivotally connecting said lower pivot arm and said upper pivot arm; and said lower fork having a fork slot, said fork slot having a width sufficient to substantially position around a tab holding post on a can top and an attachment arm of a can tab; and said upper can support having a shape which is at least partially capable of resting upon or substantially near a portion of a topmost seam or rim of said can when said lower fork is positioned around said tab holding post and said attachment arm whereby as said first handle is displaced toward said second handle said can tab is removed; and said upper can support further comprising a substantially half spherical form having an equator which forms a substantially circular ring; and said circular ring having a diameter substantially equivalent to or smaller than an inside diameter of a mouth of said can; and a slot within said half spherical form and positioned to provide clearance for said lower pivot arm when said first handle is displaced toward said second handle.

2. The pop tab remover as set forth in claim 1, said pivot further comprising:

a shaft through one or more holes in said lower pivot arm or said upper pivot arm.

3. A pop tab remover comprising:

a head apparatus having a lower fork and an upper can support; and a lower pivot arm and a first handle assembly attached with said lower fork; and an upper pivot arm and a second handle assembly attached with said upper can support; and a pivot shaft through a hole in each of said lower pivot arm and handle assembly and said upper pivot arm and handle assembly; and said lower fork comprising a substantially planar material having a fork slot, said fork slot having a width equivalent to or greater than an attachment arm of a tab of a can; and said upper can support having an at least partial dome shape with substantially an equator of said dome forming an at least a partially circular ring having an equivalent diameter approximately equivalent to a topmost rim of the can; and said fork sized to slide between the can tab and the can and said upper can support positioned with said upper pivot arm to touch with the can substantially near or on the topmost rim of the can whereby the tab is removed as said first handle assembly is displaced toward said second handle assembly; and a torsion spring pivotally mounted with said pivot shaft; and said torsion spring having one or more arms engaged with at least a portion of said arm and handle assemblies; and a slot within at least a portion of said partial dome shape, said slot having a width sufficient to provide clearance for said lower pivot arm when said handle assembly displaced.

4. The pop tab remover as set forth in claim 3 further comprising:

one or more at least partially tubular supports attached with one or more of said handle assemblies.

* * * * *